US006912746B2

(12) United States Patent
Grove

(10) Patent No.: US 6,912,746 B2
(45) Date of Patent: Jul. 5, 2005

(54) BED

(75) Inventor: Christopher John Grove, Cambridgeshire (GB)

(73) Assignee: Medi-Plinth Limited, Ipswich (GB)

( * ) Notice: Subject to any disclaimer, the term of this patent is extended or adjusted under 35 U.S.C. 154(b) by 40 days.

(21) Appl. No.: 10/295,173

(22) Filed: Nov. 15, 2002

(65) Prior Publication Data

US 2003/0093863 A1 May 22, 2003

(30) Foreign Application Priority Data

Nov. 17, 2001 (GB) ..... 0127621

(51) Int. Cl.[7] ..... A61G 7/015

(52) U.S. Cl. ..... 5/618; 5/610; 5/624; 5/601; 297/325; 297/423.21

(58) Field of Search ..... 5/618, 610, 624, 5/601, 616; 297/423.21, 423.22, 423.23, 344.1, 325, 329

(56) References Cited

U.S. PATENT DOCUMENTS

| | | | | |
|---|---|---|---|---|
| 3,147,039 A | * | 9/1964 | Smith et al. | 297/90 |
| 3,149,349 A | | 9/1964 | Nelson | |
| 3,893,197 A | * | 7/1975 | Ricke | 5/651 |
| 3,964,786 A | | 6/1976 | Mashuda | 297/330 |
| 4,227,269 A | | 10/1980 | Johnston | |
| 4,409,695 A | | 10/1983 | Johnston et al. | |
| 5,366,036 A | | 11/1994 | Perry | 180/65.1 |
| 5,402,544 A | * | 4/1995 | Crawford et al. | 5/616 |
| 5,682,631 A | * | 11/1997 | Weismiller et al. | 5/618 |

FOREIGN PATENT DOCUMENTS

| | | | |
|---|---|---|---|
| EP | 0558858 | 9/1993 | A61G/5/00 |
| EP | 0586765 | 3/1994 | A61G/5/14 |
| WO | WO 7900647 | 9/1979 | |
| WO | WO 9822071 | 5/1998 | |
| WO | WO 9955276 | 11/1999 | |

OTHER PUBLICATIONS

European Search Report for EP 02 25 7754 dated Aug. 26, 2003.

Kinetic Concepts, Inc., Magnum 800™, Brochure, 1998.

* cited by examiner

*Primary Examiner*—Alexander Grosz
(74) *Attorney, Agent, or Firm*—Bourque & Assoc.

(57) ABSTRACT

This invention relates to a bed for accommodating heavy persons. The bed is particularly for use in hospitals, where heavy patients have to be treated. The invention provides a bed comprising a frame; a central support section mounted on the frame; two opposite end support sections, one being a head section and the other being a foot section, each mounted for pivoting movement relative to the central section; and drive means for driving the end support sections for pivoting movement relative to the central section; wherein the foot section has a platform which extends at an angle to the plane of the section, and the foot section can pivot to a position where the platform is substantially at ground level. In a particularly preferred embodiment the central section is mounted for pivoting movement about a pivot axis at or near to its edge adjacent the foot section and further comprises drive means for driving the central support section for pivoting movement about said pivot axis.

6 Claims, 6 Drawing Sheets

BED

TECHNICAL FIELD

This invention relates to a bed for accommodating heavy persons. The bed is particularly for use in hospitals, where heavy patients have to be treated.

BACKGROUND INFORMATION

Many abnormally heavy persons become hospitalised because of their excessive weight. Such persons are likely to weigh 150 kg or more. It is not possible for nursing staff to maneuver people of this weight, and special hoists or other arrangements are conventionally used when it is necessary to turn the patient over or to move them from a recumbent position to a sitting or upright position. Such patients will also from time to time require treatments to be performed on their bodies, and for this purpose it has hitherto been necessary to remove the patient from the bed and move them to a treatment station.

SUMMARY OF THE INVENTION

According to the invention, there is provided a bed for heavy persons, the bed comprising a frame, a central support section mounted on the frame and two opposite end support sections, one being a head section and the other being a foot section, each mounted for pivoting movement relative to the central section, wherein the foot section has a platform which extends at an angle to the plane of the section, and the foot section can pivot to a position where the platform is substantially at ground level, the bed also including drive means for driving the end sections for pivoting movement relative to the frame.

The platform is particularly useful for assisting a patient from an upright position to a seated or recumbent position.

Preferably the platform can be retracted or removed when the bed is arranged with the foot section in a horizontal plane. The platform may be detachable from the foot section, or it may fold away relative to the foot section. In a preferred form, the platform has legs which can be inserted into or removed from sockets permanently attached to the foot section, so that the platform can be completely detached from the bed.

Preferably the central section can be pivoted forward, about a pivot axis at or near to its edge adjacent the foot section. This enables a patient whose weight is supported on the central section to be assisted in transferring their weight from the central section to the platform.

Preferably the platform makes an angle of between 90° and 120° to the foot section.

The bed may include separate drive means, for example in the form of electric actuators or hydraulic piston/cylinder units for (a) raising the central section, (b) lowering the central section (c) altering the angle of the head section relative to the central section, (d) altering the angle of the foot section relative to the central section, and (e) tilting the central section relative to the frame.

All the electric actuators can be electronically controlled from a single control unit. The control unit can be programmed to produce a series of small movements of all the bed sections over a period of time, so that the contact areas between a patient on the bed and the bed are continually changed.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
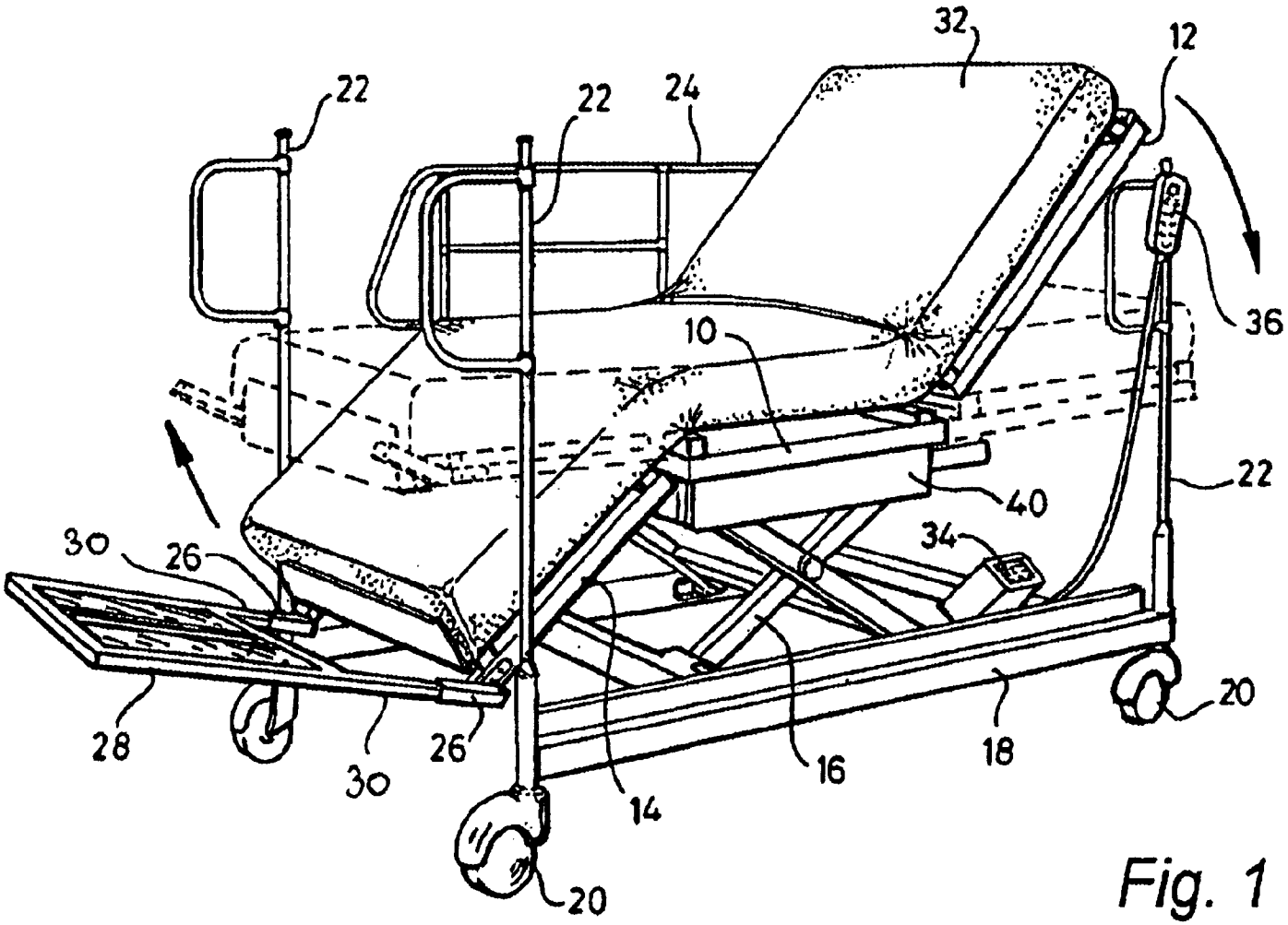
FIG. 1 is a perspective view of a bed in accordance with the invention.

FIG. 1 shows a bed which has a central section 10, a head section 12 and a foot section 14. The central section 10 is mounted by means of a scissor jack arrangement 16 on a base frame 18. The base frame 18 has castors 20, corner posts 22 and side bars 24, one of which is shown in dotted lines on the far side of the bed. The side bar on the near side has been removed to enable the remaining parts of the bed to be clearly seen. The side bars can be in the raised position as shown (to prevent a patient accidentally rolling off the bed) or in a lowered position where they are hinged down through 180° and prevent no obstruction above the surface of the bed.

Figure 11:
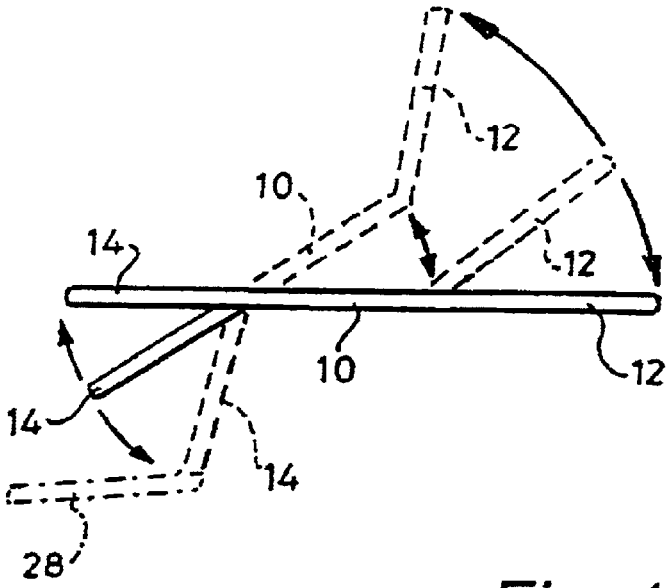
FIG. 11 illustrates the full range of movement of the various sections of the bed.
Figure 12:
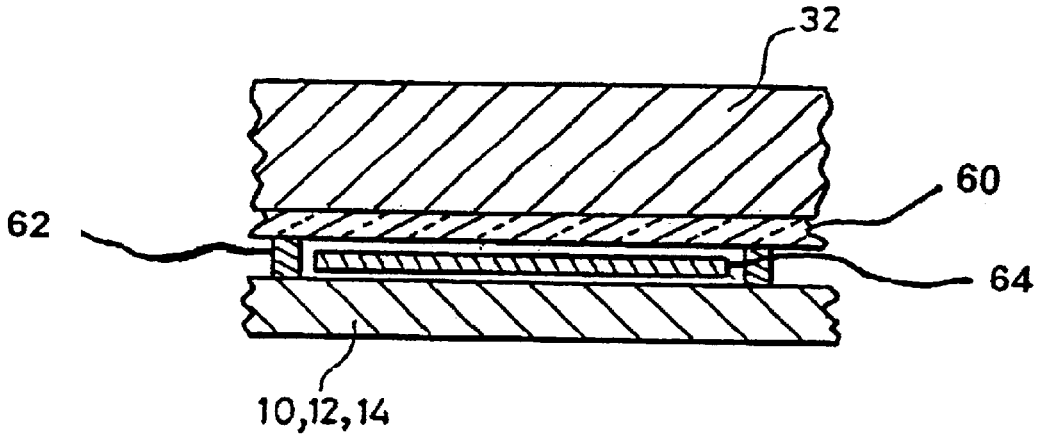
FIG. 12 is a cross-section through a section of the bed, showing a further detail.

The head section 12 and foot section 14 are both hinged to the central section 10 and can be moved, as shown in FIG. 11, between positions where all the sections lie in the same, horizontal plane so that a patient lying on the bed is in a recumbent position, or positions inclined relative to the central section.

The foot section 14 is provided with sockets 26 into which a footboard 28 can be slotted. The footboard 28 has legs 30 which can be engaged with and disengaged from the sockets 26, and foot plate areas 33 on which a patient can stand.

A mattress 32 is placed on the sections 10, 12, 14.

The support for the central section 10 can incorporate a load cell to provide a read out of the weight of the patient on the bed, and the patient's weight can for example be displayed on a screen 34.

Adjustment of the relative positions of the sections 10, 12, 14 can take place through individual electric actuator units (jacks), in a manner as will be described below. The electric actuators can be activated through use of a remote control unit 36 or a computerized touch screen.

The remote control unit can be arranged so that the patient can alter the position of section of the bed themselves. In this case a 'master' control unit may also be provided which allows one or more of the actuators to be disabled, for example if the patient has a broken leg then it may be desirable to disable movement of the foot section.

Figure 2:
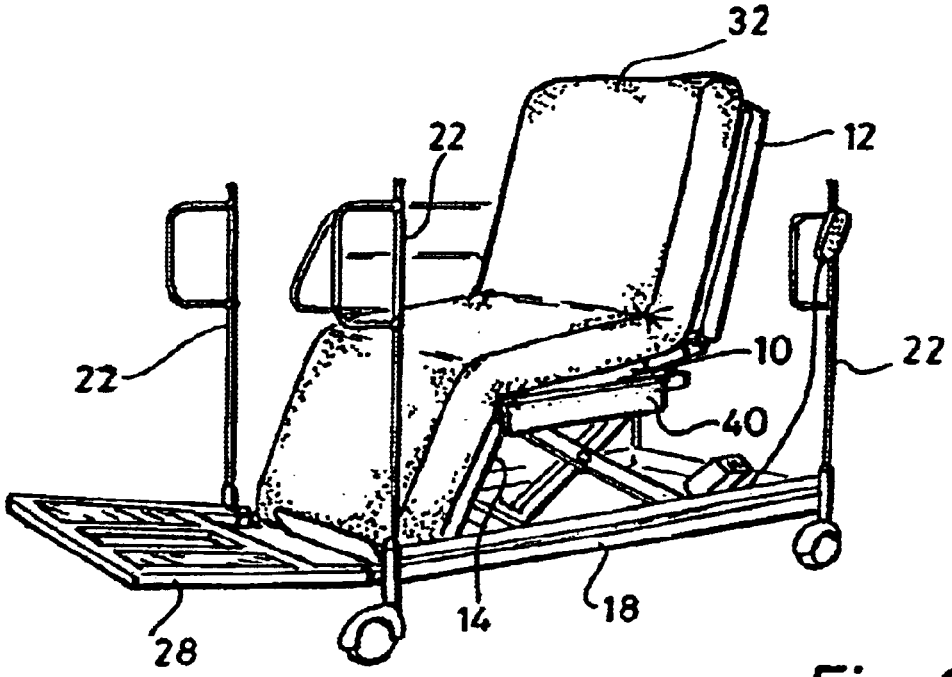
FIGS. 2 and 3 show the bed of FIG. 1 in two alternative positions.
Figure 3:
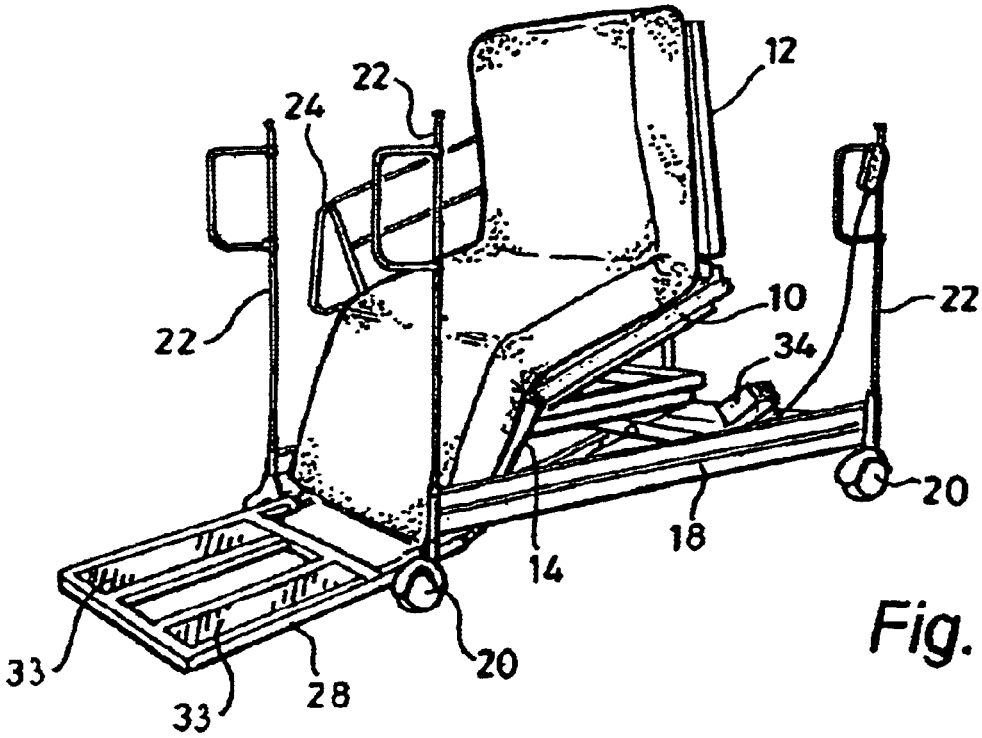
Figure 4:
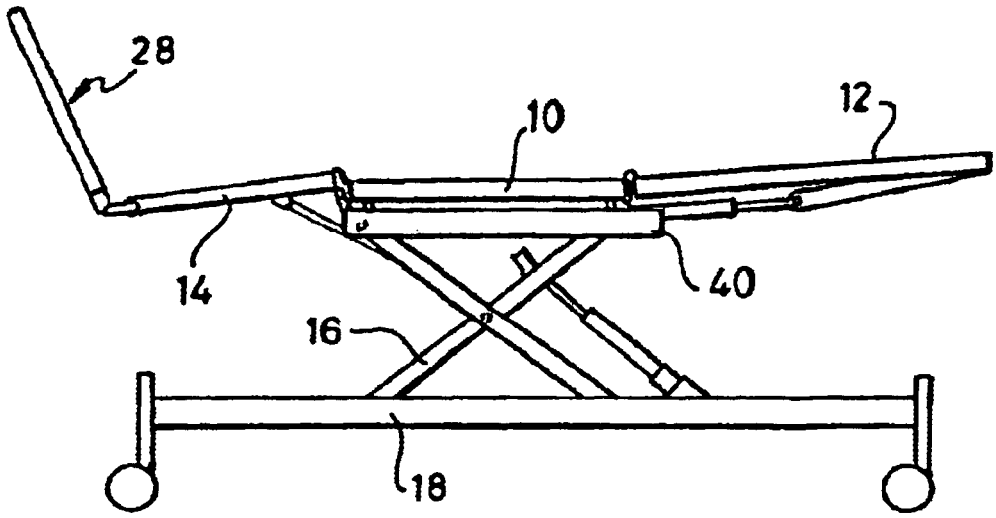
FIG. 4 is a side view of the bed of FIG. 1, with the mattress and certain other parts removed.

FIG. 2 shows the bed with the positions of the sections adjusted to form a chair, and with the footboard 28 in position. FIG. 3 shows the bed with the central section 10 tipped forward, to assist the patient in achieving a standing position, standing on the footboard 28. In this position, the footboard is parallel to the floor to make for easy dismounting from the chair to the ground.

Figure 5:
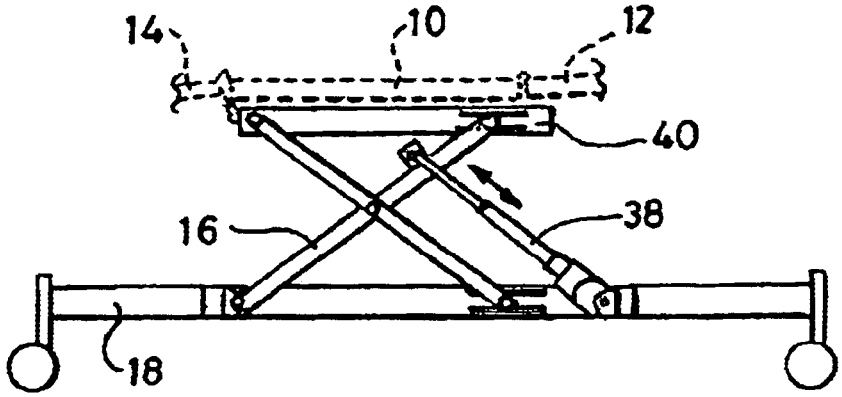
FIGS. 5 to 8 are views similar to FIG. 2 with each illustrating a particular range of movement.

The bed has five electric actuator units, to control the various different movements of the sections 10, 12, 14 and the positioning and functioning of those motors will be described with reference to the following schematic drawings. FIG. 5 shows an electric actuator 38 for controlling parallel lift of the center section 10. The center section 10 is supported on an upper frame 40, and the scissor mechanism 16 works between the base 18 and the upper frame 40. As will be seen from FIG. 5, extension of the electric actuator 38 operates the scissor mechanism and raises the upper frame 40 whilst maintaining the base 18 and frame 40 parallel to one another.

Figure 6:
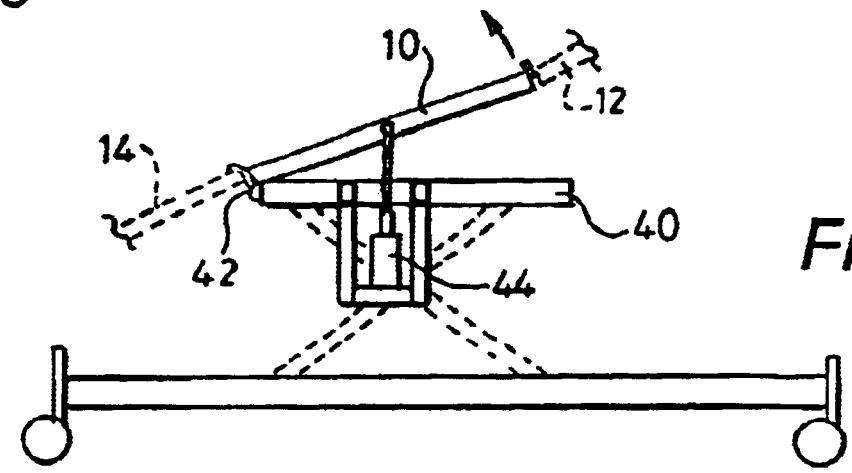

FIG. 6 shows how the center section 10 can be tilted. The center section 10 is pivoted at 42 on the upper frame 40, and a second electric actuator 44 acts between the upper frame 40 and the center section 10, so that when the electric actuator 44 is extended, the section 10 is tilted as shown.

It will be noted from FIGS. 5 and 6 that the head section 12 is hinged to the center section 10, rather than to the upper frame 40.

Figure 7:
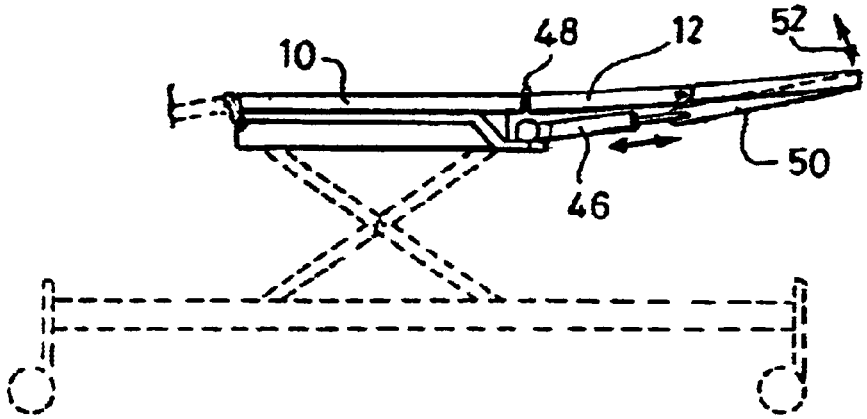

FIG. 7 shows a third electric actuator 46 which controls pivoting movement of the head section 12 relative to the center section 10, about pivot axis 48. One end of the electric actuator 46 (the end which carries the cylinder) is mounted on the upper frame 40, and the piston rod is connected to a fixed link 50 connected to the top end of the head section 12. Extending the electric actuator 46 results in movement of the head section 12 as indicated by arrow 52.

Figure 8:
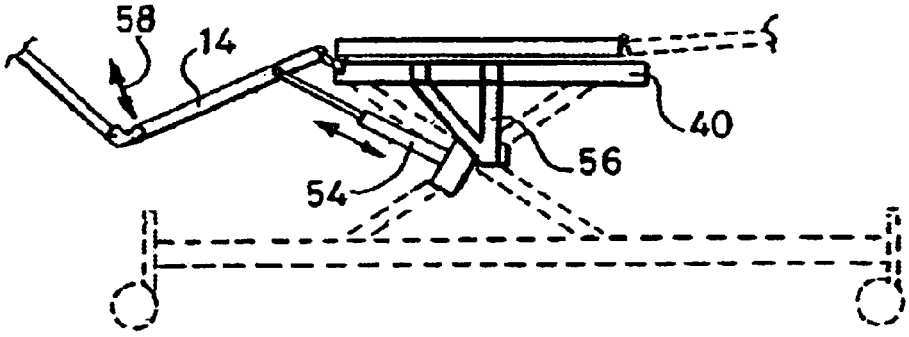

Finally, the foot section 14 can be pivoted (FIG. 8) by means of a fourth electric actuator 54 which is mounted at one end on a rigid structure 56 mounted below and suspended from the upper frame 40. Extension and retraction of the piston of the electric actuator 54 produces motion of the foot section 14 as indicated by the double-headed arrow 58.

Figure 9:
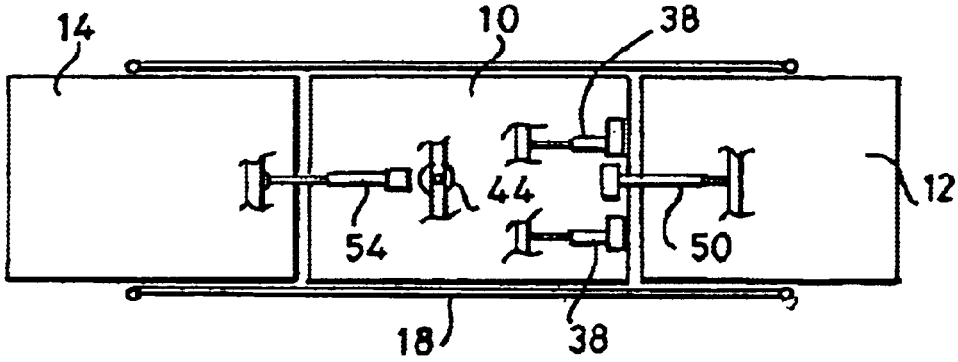
FIG. 9 is an underneath view of the bed, again with certain parts omitted.
Figure 10:
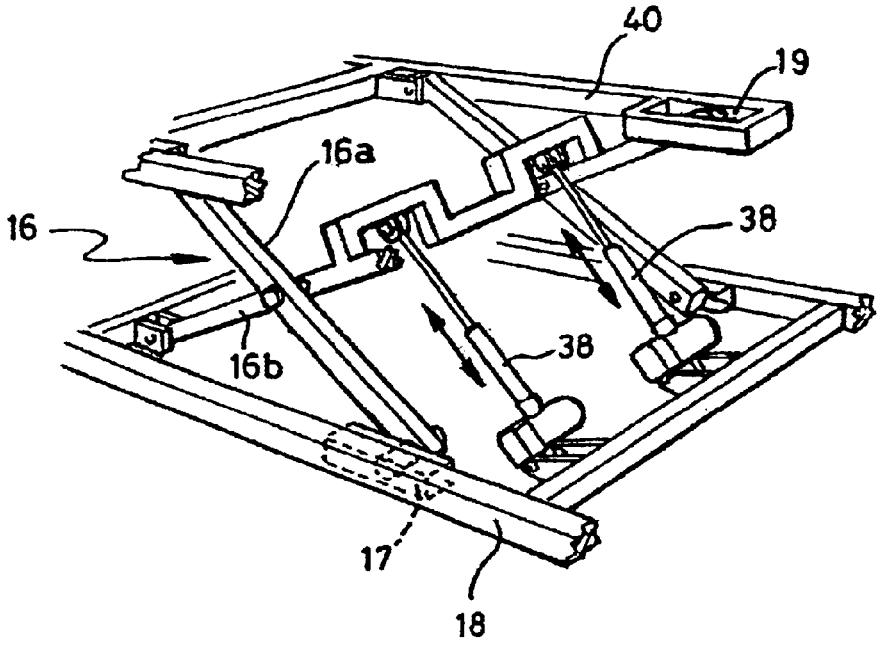
FIG. 10 is a scrap perspective view illustrating part of the lifting mechanism.

FIG. 9 shows a schematic underview of the three sections of the bed. The unit 38 which performs the vertical movement of the upper frame 40 comprises two symmetrically arranged electric actuator units 38, as can be seen in FIGS. 9 and 10. Both of these units operate raising and lowering of the central section.

The electric actuators can be driven from an on-board battery which provides the source of electrical power, and can be associated with an on-board charger, so that the bed can be operated away from a source of main power, but the battery can be easily recharged.

The footboard 28 in the embodiment shown has only one position relative to the foot section 14, but can be put in place or removed simply by sliding the legs 30 into or out of the sockets 26.

In operation, a patient on the bed can be moved by the electric actuators from a lying or recumbent position to a seated position (FIG. 2) where the head section 12 is upright or almost upright.

When the footboard 28 is in position, the central section 10 can be tipped so that the footboard 28 contacts or nearly contacts the ground (FIG. 3) and the patient is brought to a near standing position from which a full standing position, with the patient's weight on the footboard can be achieved. The patient can then step forward off the footboard, and the work of lifting the patient's weight is largely carried out by the electric actuators.

It is also possible for the electric actuators to be subject to electronic control. This will enable the inclination of the three sections 10, 12, 14 to be regularly and continuously changed, perhaps in a random order, so that the areas of contact between the patient and the bed are continually changed. This helps to avoid the formation of bed sores which occur when the patient's weight is transferred to the bed through a single part of the patient's body over a long period.

Furthermore, when in a seated position, it is possible for the patients joints to 'lock' if the patent remains in one position for too long. In this case small movements of the three section 10, 12, 14 will help to alleviate this problem.

FIG. 10 shows the scissor mechanism 16 in more detail. One link 16*a* is mounted on a fixed pivot axis to the upper frame 40, and at its other end is mounted for horizontal sliding movement in a track 17. The other link 16*b* is fixed to the base frame 18 and is mounted for sliding movement on the upper frame 40, at 19. This arrangement ensures that the upper and base frames remain parallel as the central section 10 is raised or lowered.

Each of the sections 10, 12, 14 have a Perspex mattress support 60 mounted above the metal frame of the respective section, by spacers 62. The mattress 32 rests on the support 60. This arrangement allows an X-ray plate 64 to be placed beneath the patient, so that X-ray photographs can be taken of the patient, without requiring the patient to be moved from the bed. The mattress support 60 can of course be of any material which is transparent to X-rays and which is strong enough to support the weight of the patient.

This bed makes it possible to care for extremely heavy patients without requiring hospital staff to undertake heavy lifting work, and without requiring hoists or the like to be brought in to lift the patient. Because of the possibility of maintaining a continuous, slight movement between the sections 10,12,14, the risk of the patient contracting bed sores is substantially diminished.

Modifications and substitutions by one of ordinary skill in the art are considered to be within the scope of the present invention which is not to be limited except by the claims which follow.

What is claimed is:

1. A bed for heavy persons, the bed comprising a frame comprising a base and an upper frame;

a central support section mounted on the frame;

two opposite end support sections, one being a head section and the other being a foot section, each mounted for pivoting movement relative to the central section; and in which the central support section is supported on the upper frame and is mounted for pivoting movement about a pivot axis at or near to its edge adjacent the foot section; and first drive means for driving the head section for pivoting movement relative to the central support section;

second drive means for driving the foot section for pivoting movement relative to the central section;

third drive means for driving the central support section for pivoting movement about said pivot axis; and fourth drive means for driving the central support section wherein a scissor mechanism works between the base and the upper frame, and the fourth drive means is arranged such that extension of the fourth drive means operates the scissor mechanism and raises the upper frame whilst maintaining the base and upper frame parallel to one another; and wherein the foot section has a platform which extends at an angle to the plane of the section, and the foot section can pivot to a position where the platform is substantially at ground level.

2. A bed according to claim 1, in which the platform is retractable or removable.

3. A bed according to claim 1, in which the platform has legs which can be inserted into or removed from sockets permanently attached to the foot section.

4. A bed according to claim 1, in which the platform makes an angle of between 90° and 120° to the foot section.

5. A bed according to claim 1 in which the drive means comprise hydraulic piston/cylinder units.

6. A bed according to claim 1 in which the drive means are electronically controlled from a single control unit.

* * * * *